US006319026B1

(12) United States Patent
Chen et al.

(10) Patent No.: US 6,319,026 B1
(45) Date of Patent: Nov. 20, 2001

(54) ELECTRICAL CONNECTOR WITH IMPROVED GROUNDING STRUCTURE FOR SHIELDING SHELL THEREOF

(75) Inventors: Qiang Chen; Guang Xing Shi; Sui Ya Wang, all of Kun-Shan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/795,895

(22) Filed: Feb. 27, 2001

Related U.S. Application Data

(63) Continuation-in-part of application No. 09/751,821, filed on Dec. 28, 2000.

(30) Foreign Application Priority Data

Oct. 24, 2000 (TW) ..... 89218471 U
Nov. 15, 2000 (TW) ..... 89219739 U

(51) Int. Cl.[7] ..... H01R 13/652
(52) U.S. Cl. ..... 439/108; 439/607; 439/573
(58) Field of Search ..... 439/108, 92, 607–610, 439/564, 571, 573, 567

(56) References Cited

U.S. PATENT DOCUMENTS 5,344,342 * 9/1994 Briones ..... 439/108
5,727,970 * 3/1998 Koguchi et al. ..... 439/607
5,921,811 * 7/1999 Hsu ..... 439/567
6,077,115 * 6/2000 Yang et al. ..... 439/607

* cited by examiner

*Primary Examiner*—Hien Vu
(74) *Attorney, Agent, or Firm*—Wei Te Chung

(57) ABSTRACT

An electrical connector includes a dielectric housing (1), a terminal module (2), a shielding shell (3), a pair of board locks (14) and a pair of rivets (13). The terminal module (2) is attached to the dielectric housing so that a plurality of terminals (4) extends through a mating projection (8) of the housing. The shielding shell encloses the mating projection. The board locks are fixed to both ends of the housing by the rivets. A resilient finger (143) is integrally formed with a corresponding board lock and contacts the shielding shell. Engaging legs (142) of the board locks are adapted to mount to a printed circuit board and connect with a grounding trace of the printed circuit board. Thus the shielding shell is electrically grounded to the grounding traces via the fingers of the board locks.

9 Claims, 8 Drawing Sheets

ELECTRICAL CONNECTOR WITH IMPROVED GROUNDING STRUCTURE FOR SHIELDING SHELL THEREOF

CROSS-REFERENCE TO RELATED APPLICATION

This application is a continuation-in-part (CIP) application of U.S. patent application Ser. No. 09/751,821 filed on Dec. 28, 2000. Both applications are assigned to the same assignee.

BACKGROUND OF THE INVENTION

1. Field of the Invention

The present invention relates to an electrical connector, and particularly to an electrical connector having an improved grounding structure for a shielding shell thereof.

2. Brief Description of the Prior Art

In the electronics industry, an electrical connector is usually mounted on a printed circuit board (PCB) for electrically connecting an external device to a PCB. The electrical connector, regardless of whether it is a plug or a receptacle connector, has a dielectric housing receiving a plurality of contacts therein. The electrical connector often has a shielding shell, which must be grounded to properly shield the contacts therein and to dissipate electrostatic charges accumulated on the shielding shell to ground.

Referring to FIG. 1, U.S. Pat. No. 4,943,244 discloses a conventional electrical connector comprising a shell 1', a housing 2', a board lock member 3' and terminals 4'. The housing 2' has a base 21' and a mating portion 20' at the front of the base 21'. A plurality of terminal receiving passages 22' are defined through the mating portion 20' and base 21' for receiving the electrical terminals 4'. The shell 1' is assembled to the housing 2' in a direction indicated by an arrow A and a shroud 10' of the shell 1' surrounds the mating portion 20'. At the same time, a pair of ground straps 11' projecting rearwardly from a bottom edge of the shell 1' engages a bottom of the base 21'. A board lock member 3' is mounted to a lateral flange of the housing 2' in a direction indicated by an arrow B to a position at which a locking tab 31' fits into a corresponding recess 23' in the flange. The ground strap 11' is then engaged with board lock member 3', whereby electrostatic charges accumulated on the shell 1' can be transmitted to ground on a printed circuit board to which locking legs 30' of the board lock members 3' are connected.

However, for this conventional connector, the shell 1' and the ground strap 11' are integrally stamped, which results in a lot of wasted material during the manufacturing process. In addition, when the connector requires a high profile, two towers are formed on lateral sides of the housing to increase the height of the connector. For such high profile connectors, the ground straps must downwardly extend a long distance relative to the shroud, which further increases the amount of wasted material during manufacturing of the shell. Furthermore, when the ground straps extend a relatively long distance from the shroud, they become very flexible and thus become difficult to correctly assemble to the housing.

Hence, an improved electrical connector is required to overcome the disadvantages of the prior art.

BRIEF SUMMARY OF THE INVENTION

An object of the present invention is to provide a high profile electrical connector having a shielding shell which can be effectively connected to ground in an economical way.

To achieve the above-mentioned object, an electrical connector in accordance with the present invention comprises a dielectric housing, a terminal module, a shielding shell, a pair of board locks and a pair of rivets. The dielectric housing has a base and a mating projection. The terminal module attaches to the base such that the base and the mating projection receive a plurality of terminals therein. Two towers downwardly extend from two lateral sides of the housing. The shielding shell encloses the mating projection of the housing. One board lock mounts in each of the towers of the housing and is adapted to mount the connector on a printed circuit board and to connect with a grounding trace of the printed circuit board. Each board lock integrally forms a resilient finger engaging against the shielding shell to electrically connect the board lock with the shielding shell.

Other objects, advantages and novel features of the present invention will become more apparent from the following detailed description of the present embodiment when taken in conjunction with the accompanying drawings.

DETAILED DESCRIPTION OF THE INVENTION

Figure 1:
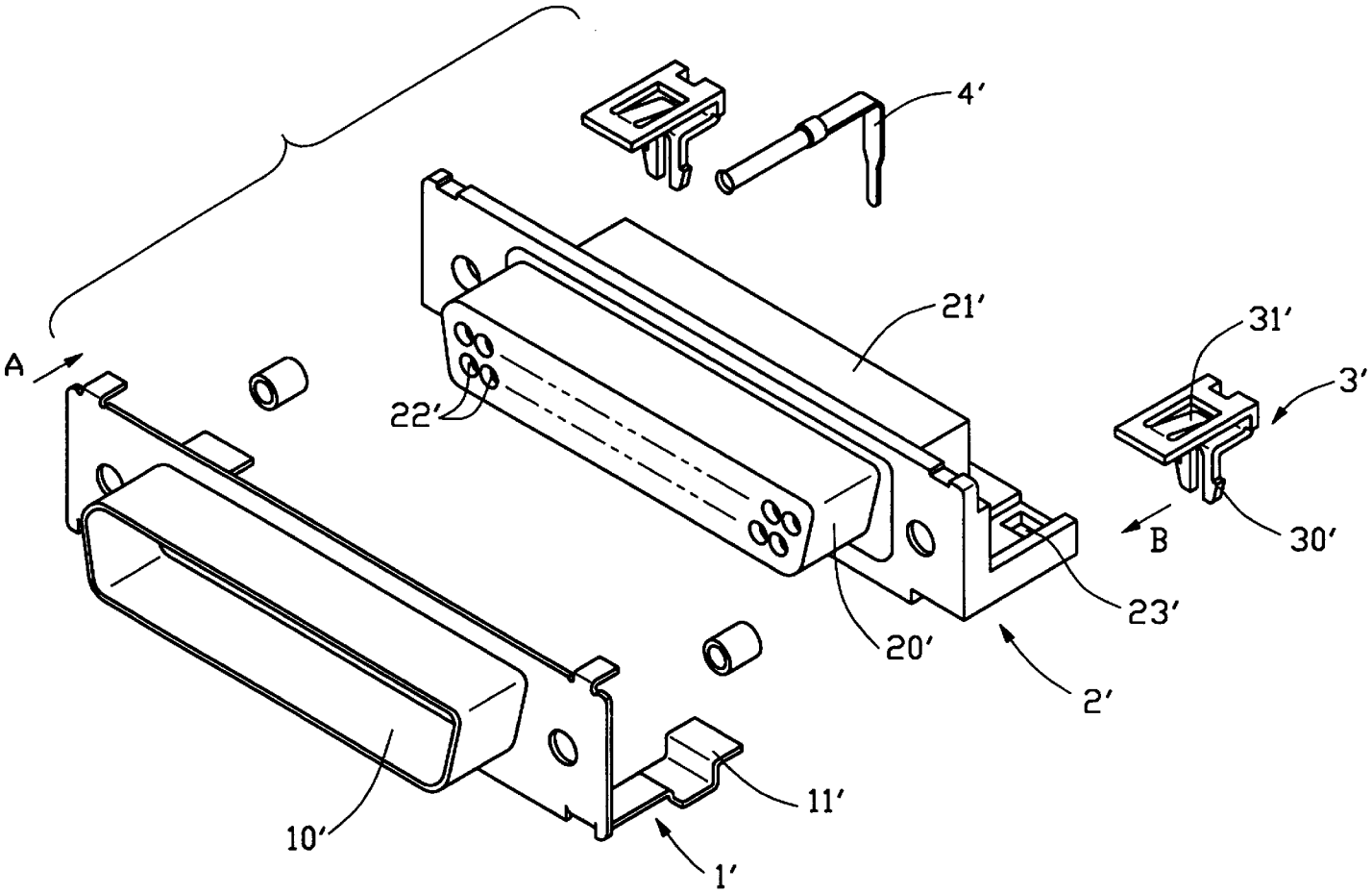
FIG. 1 (PRIOR ART)
FIG. 1 is an exploded view of a conventional electrical connector.
Figure 2:
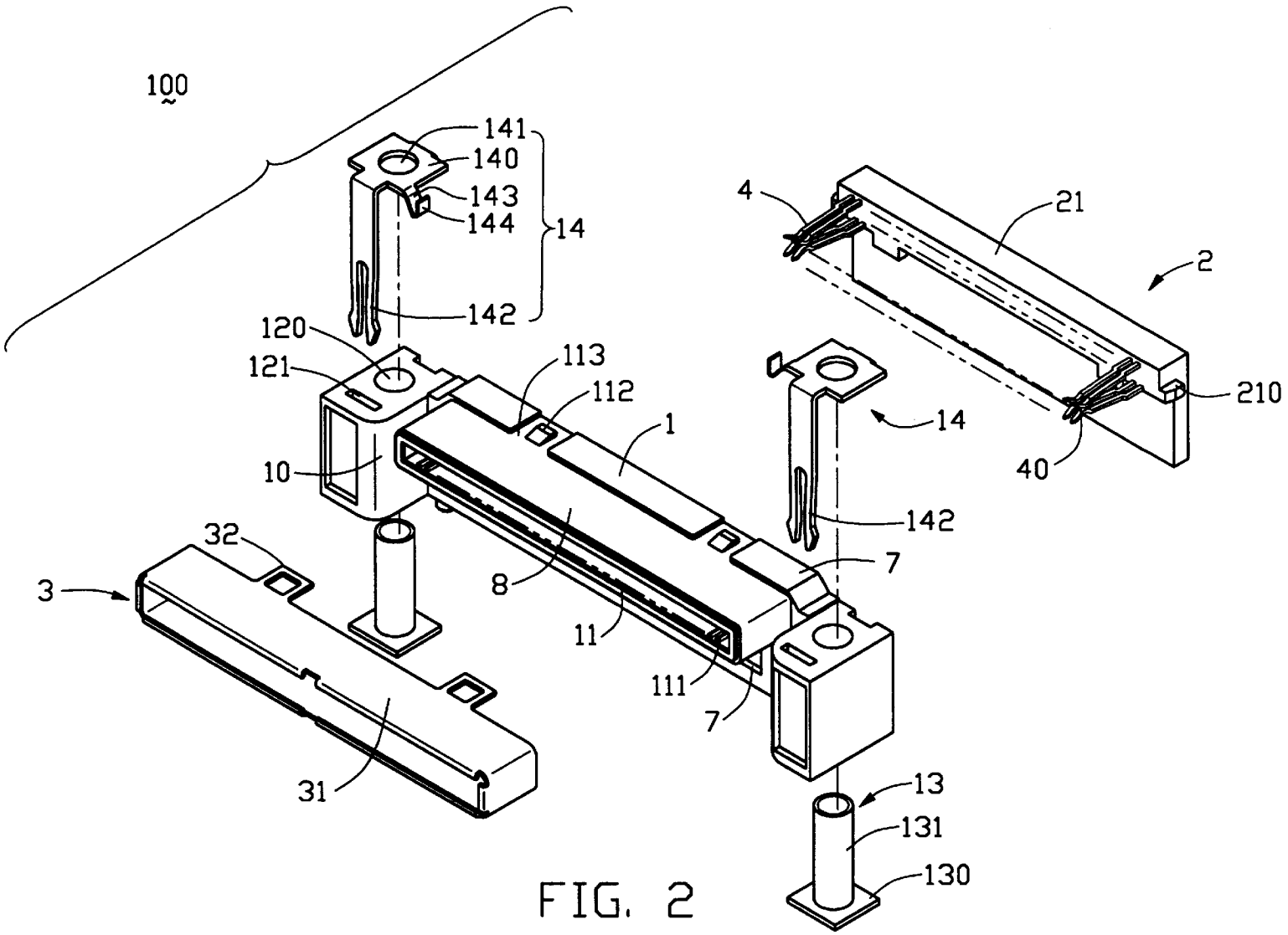
FIG. 2 is an exploded view of an electrical connector in accordance with a first embodiment of the present invention.
Figure 3:
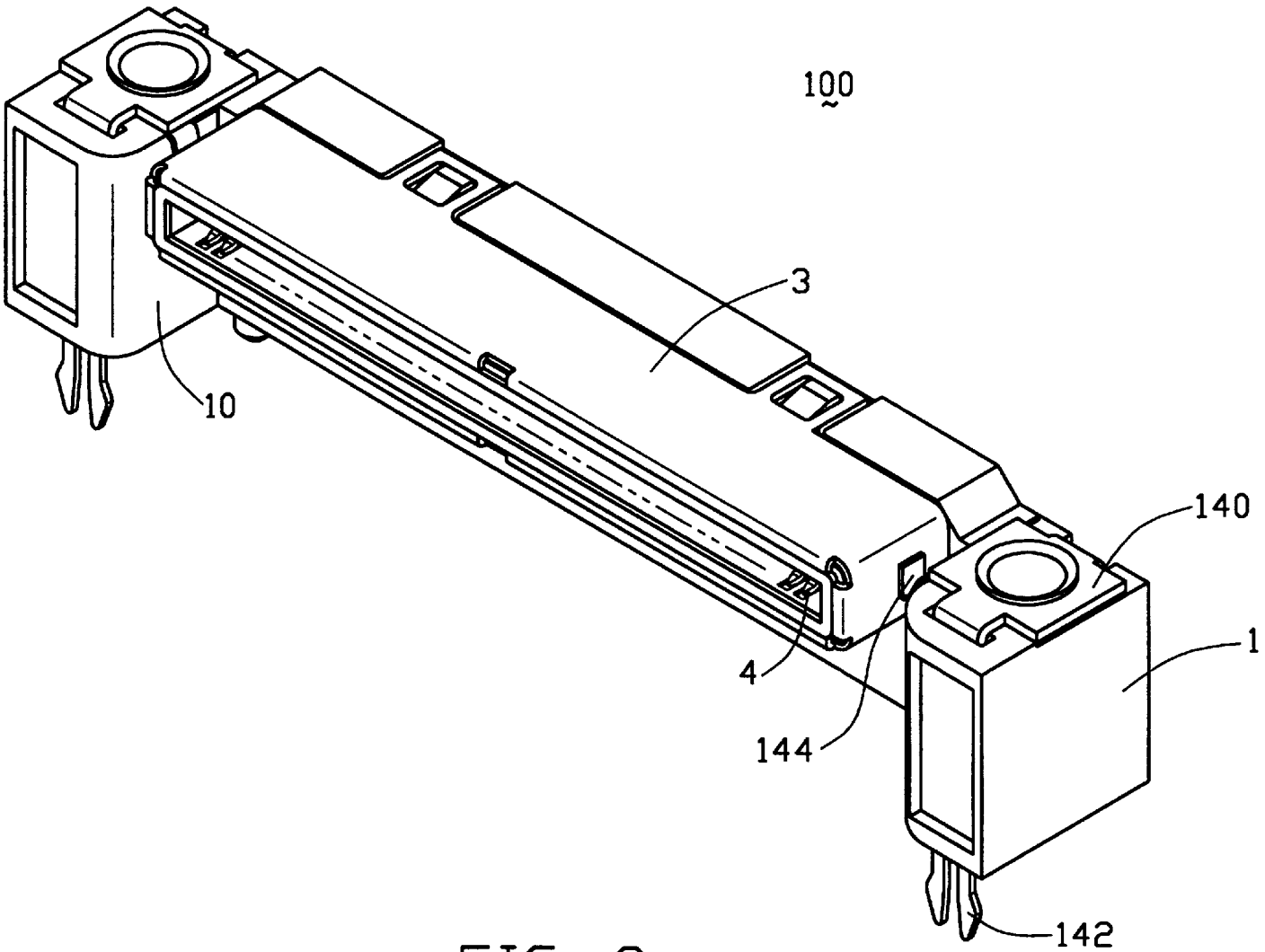
FIG. 3 is a perspective assembled view of the electrical connector of the present invention.

Referring to FIG. 2 and FIG. 3, an electrical connector 100 of the present invention comprises a dielectric housing 1, a terminal module 2, a shielding shell 3, a pair of board locks 14, and a pair of rivets 13.

The housing 1 has a high profile structure and forms a base 7 extending its full height, and a mating projection 8 protruding forwardly from an upper portion of the base 7. A slot 11 is defined horizontally through the mating projection 8 and the base 7 of the housing 1. A plurality of terminal receiving passageways 111 is defined in upper and lower portions of an inner face of the mating projection 8 and the base 7 and in communication with the slot 11. Particularly referring to FIG. 5, a pair of recesses 101 is defined in a rear side of the base 7 beside and in communication with the slot 11. A pair of projections 112 is formed on a top surface 113 of the base 7. Each of two sides of the housing 1 forms a tower 10 downwardly extending a distance relative to the mating projection 8. A round hole 120 and a rectangular slit 121 are defined vertically through each of the towers 10 with the round hole 120 located rear of the rectangular slit 121.

The terminal module 2 consists of a vertical board 21 and a plurality of terminals 4 assembled in the board 21 by insert molding. Each terminal 4 has a contact portion 40 horizontally extending to a front of an upper portion of the board 21 for mating with a corresponding contact of a complementary connector (not shown). A tail portion 41 (better seen in FIG. 5) horizontally rearwardly extends at a bottom of the board 21 for soldering to a printed circuit board (not shown) by surface mounting technology. An ear 210 is formed on each of two sides of the vertical board 21.

The shielding shell 3 has a hollow shroud 31 and a plurality of latching tabs 32 project rearwardly from the shroud 31.

The rivets 13 each consist of a rectangular flat base 130 and a tubular member 131 extending upwardly from the base 130.

Each board lock 14 has a rectangular platform 140, an elongate leg 142 depending downwardly from a front edge of the platform 140, and a resilient finger 143 extending from a lateral edge of the platform 140 toward the mating projection 8. The platform 140 defines a central hole 141. Each leg 142 forms a bifurcated lower end for resiliently clamping a printed circuit board (not shown). Each finger 143 is downwardly inclined relative to the platform 140 and then reversed to provide a flat abutting pad 144 at a free end thereof. For good resilience, the fingers 143 are made thinner than the platform 140. The fingers 143 can be easily altered to engage with the shroud 31. Since in the present invention the board locks 14 and the shielding shell 3 are separately formed, to meet different height requirement of the mating projection 8 above the printed circuit board, only the length of the board locks 14 needs to be modified, without a necessity of altering the shielding shell 3.

Figure 4:
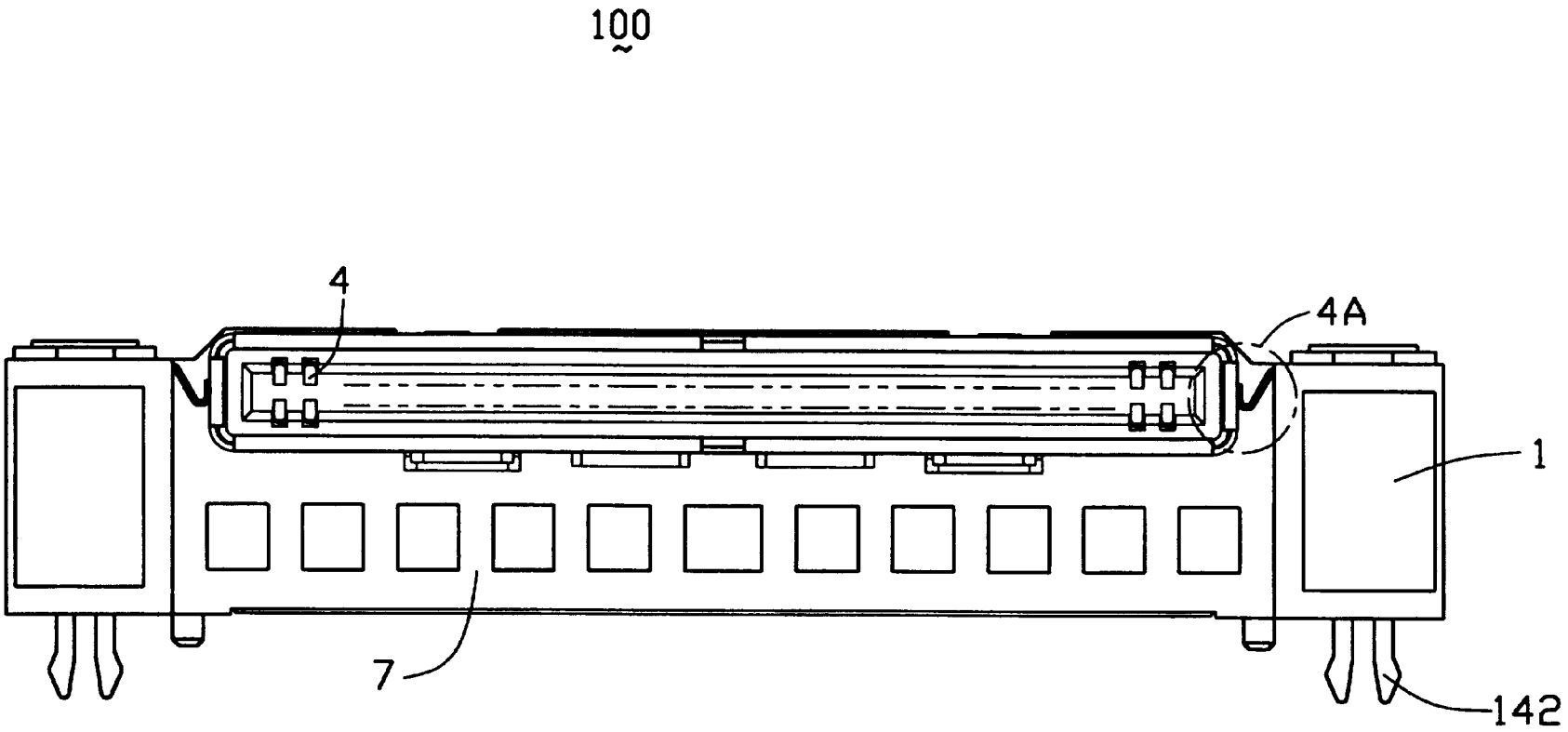
FIG. 4 is a front view of the electrical connector of the present invention.
Figure 4A:
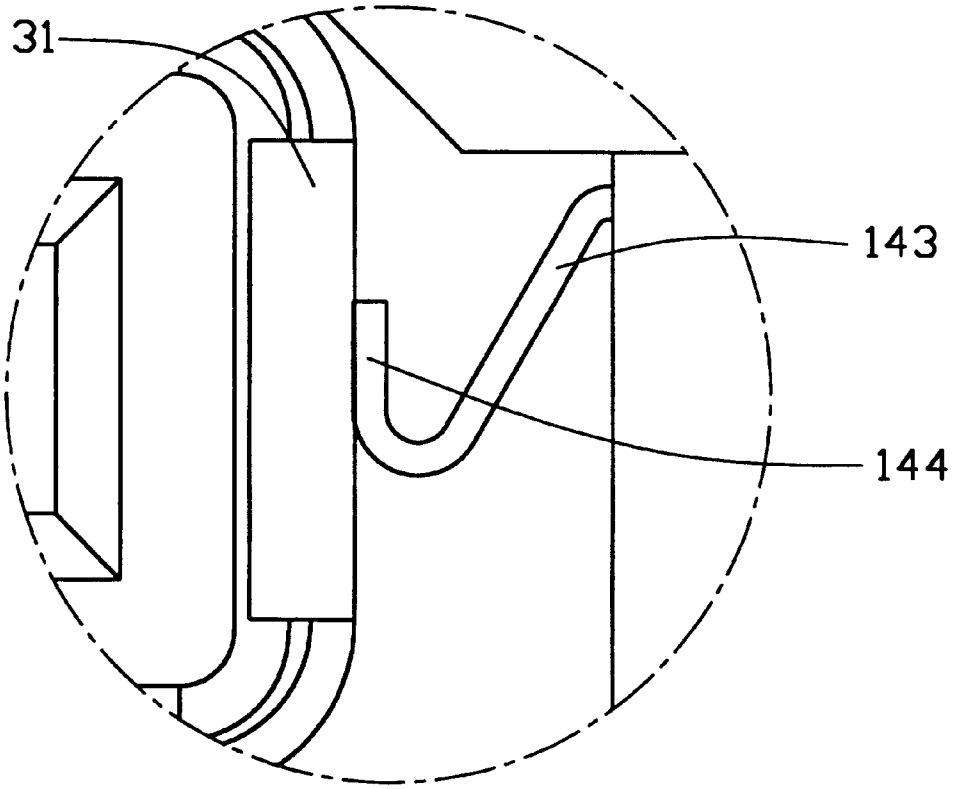
FIG. 4A is a partially enlarged view of a part of FIG. 4 indicated by a circle 4A.
Figure 5:
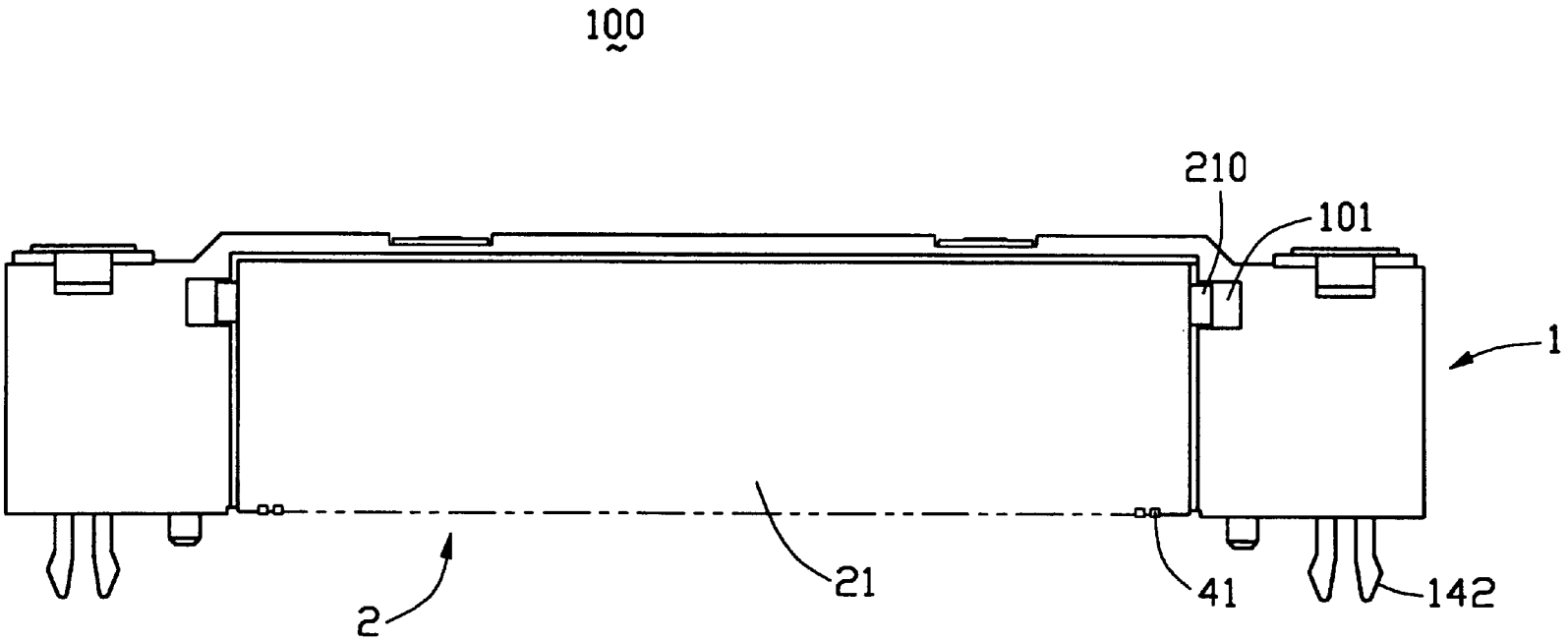
FIG. 5 is a rear view of the electrical connector of the present invention.

In assembly, also referring to FIGS. 3–5, the terminal module 2 is attached to the housing 1 from a rear side of the housing 1. The contact portions 40 of the terminals 4 are inserted into the slot 11 and are received in corresponding terminal receiving passageways 111. The ears 210 of the terminal module 2 are received in the recesses 101 of the housing 1 to secure the terminal module 2 in the housing 1. The shielding shell 3 is then assembled to the housing 1 by engaging the latching tabs 32 with the protrusions 112 on the top surface 113 of the base 7. The shroud 31 thereby encloses the mating projection 8 to shield the contact portions 40 of the terminals 4. The tubular members 131 of the rivets 13 extend into the round holes 120, respectively, from a bottom of the towers 10. The engaging legs 142 of the board locks 14 extend downwardly through the rectangular slits 121 from a top of the towers 10. Each tubular member 131 extends through the central hole 141 of each platform 140 which abuts against a top surface of the tower 10. Finally, top ends of the tubular members 131 are subjected to a riveting operation, thereby fixedly connecting the rivets 13 and the board locks 14 to the towers 10.

When the connector is mounted to the printed circuit board, electrostatic charges accumulated on the shielding shell 3 can be transmitted to ground by the board locks 14 since the engaging legs 142 of the board locks 14 are soldered to grounding traces on the printed circuit board and the shroud 31 of the shielding shell 3 and the board locks 14 are electrically connected together through the resilient fingers 143.

Figure 6:
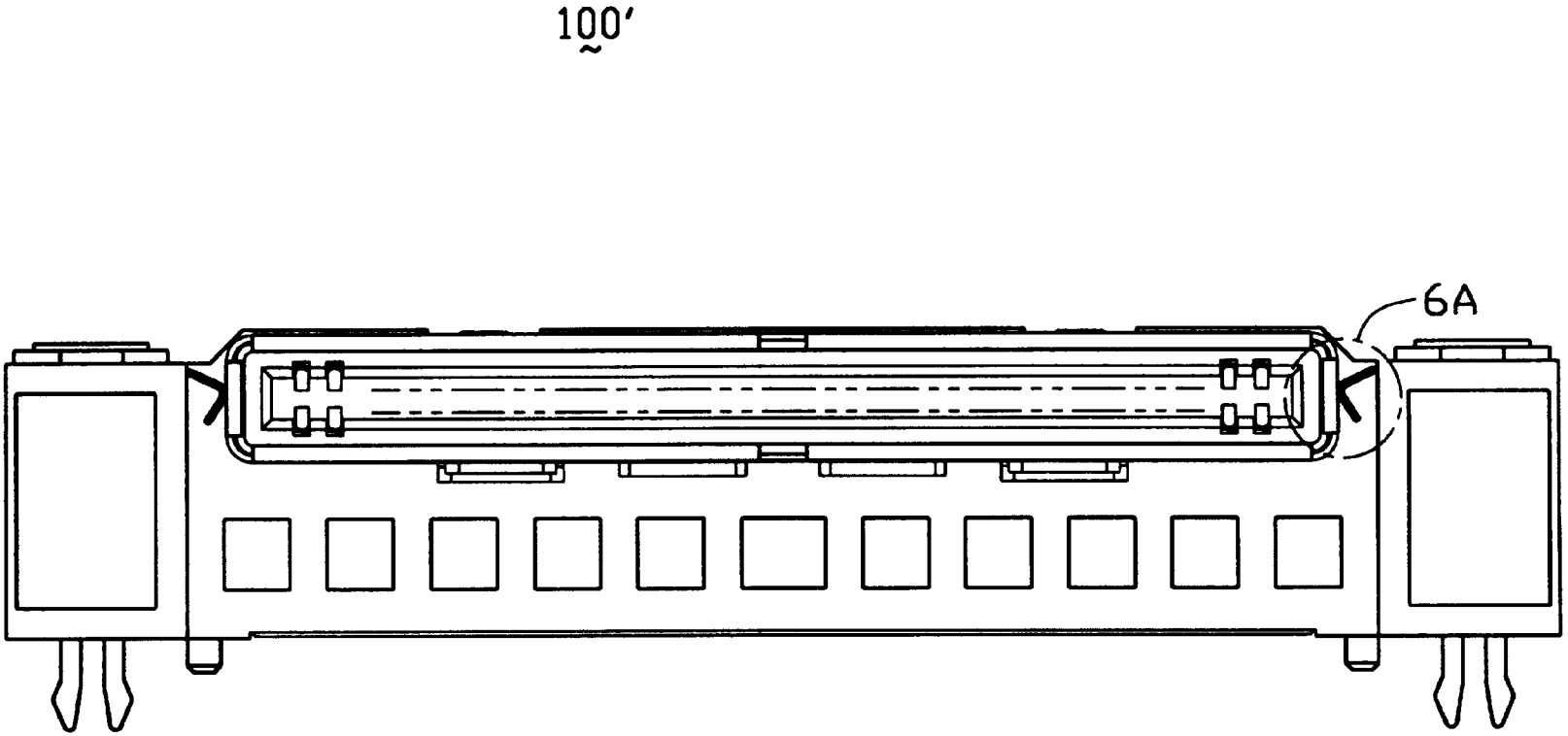
FIG. 6 is a view similar to FIG. 4 showing an electrical connector in accordance with a second embodiment of the present invention.
Figure 6A:
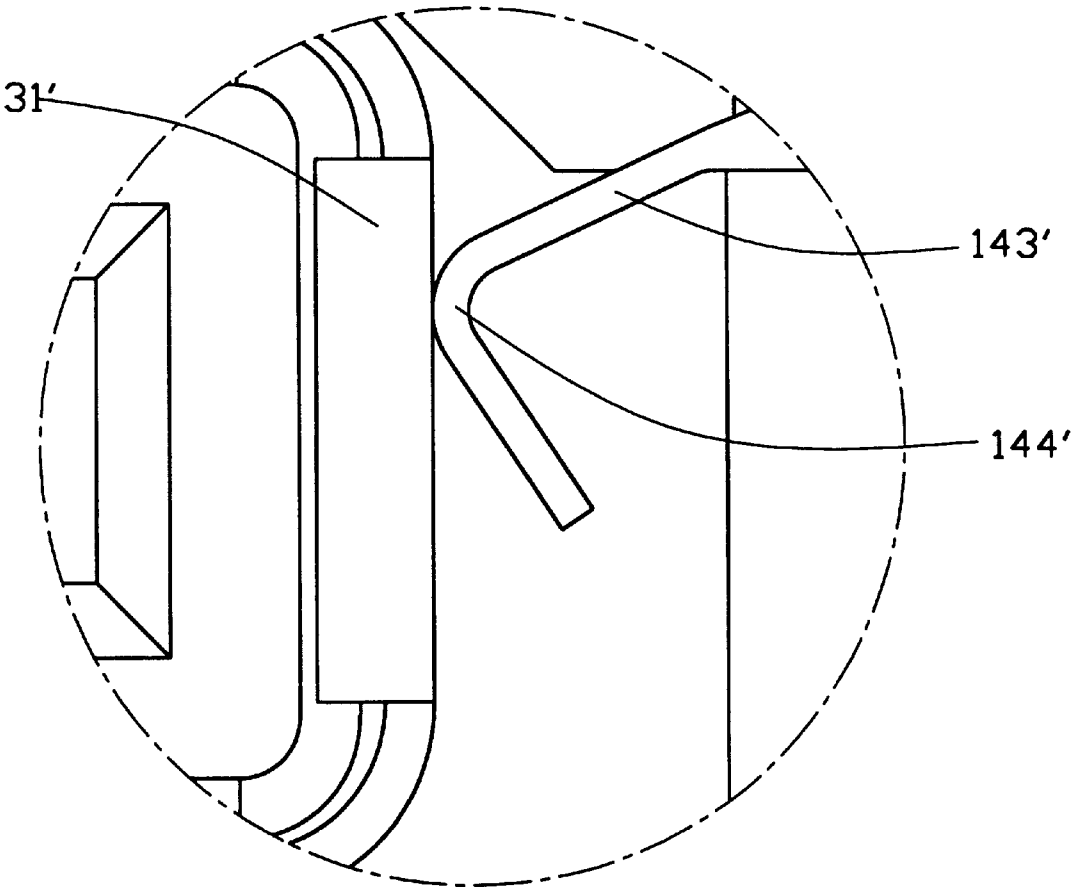
FIG. 6A is a partially enlarged view of a part of FIG. 6 indicated by a circle 6A.

FIGS. 6 and 6A show a second embodiment of the present invention, which is substantially the same as the first embodiment except for the configuration of the resilient fingers. In the second embodiment, the fingers 143' extend inwardly toward the shroud 31' and then reverse to forms an apex 144' abutting against a corresponding side of the shroud 31'.

From the above disclosures, it is clear that the present inventions provide effective and economical apparatuses for grounding shielding shells of high profile connectors.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a dielectric housing having a base, a mating projection extending forward from the base, and two towers formed at two lateral sides of the base;

a plurality of terminals being received in the base and protruding into the mating projection;

a shielding shell enclosing the mating projection of the housing;

at least one board lock mounted in each of the towers of the housing for electrically connecting with a grounding trace of a printed circuit board on which the connector is mounted, the board lock forming a finger extending toward the mating projection and abutting against the shielding shell for establishing an electrical connection between the shielding shell and the board lock;

at least one rivet extending through a corresponding tower and a platform of the board lock to fixedly connect the board lock and the tower together; and a terminal module, the terminal module comprising a board, the board being attached to a rear side of the housing, the terminals being inserted molded in the board, each terminal having a contact portion horizontally extending into a slot defined in the housing, and a tail portion horizontally extending from a bottom of the board.

2. The electrical connector as claimed in claim 1, wherein the board lock has a resilient finger with a downwardly curved configuration, the resilient finger resiliently abutting against the shielding shell at a free end thereof.

3. The electrical connector as claimed in claim 2, wherein the free end of the finger is flat to fittingly engage with the shielding shell.

4. The electrical connector as claimed in claim 1, wherein the board lock has a resilient finger which forms an apex resiliently abutting against the shielding shell.

5. The electrical connector as claimed in claim 4, wherein the finger extends inwardly toward the shield and then reverse, thereby forming the apex at the turning point.

6. The electrical connector as claimed in claim 5, wherein the board locks each have engaging legs downwardly extending from a side of the platform and through a slit defined in the corresponding tower, said engaging legs being adapted for soldering to the grounding traces thereof.

7. An electrical connector, comprising:

a dielectric housing having a base, a mating projection extending forward from the base, and two towers formed at two lateral sides of the base;

a plurality of terminals being received in the base and protruding into the mating projection;

a shielding shell enclosing the mating projection of the housing;

at least one board lock mounted on each of the towers of the housing for electrically connecting with a grounding trace of a printed circuit board on which the connector is mounted, the board lock including a leg extending in a direction perpendicular to a mating direction of said mating projection, and a rivet extending through said each of the towers in said direction to secure the board lock to the housing; wherein a finger integrally extends from the board lock toward the mating projection and abuts against the shielding shell for establishing an electrical connection between the shielding shell and the board lock; wherein each of said towers defines a round hole and a slit, and the corresponding rivet and board lock extend therethrough, respectively.

8. The connector as claimed in claim 7, wherein said board lock includes a platform, and said leg and said finger respectively extend from two different sides thereof.

9. The connector as claimed in claim 7, wherein said finger is thinned to increase resiliency thereof.

* * * * *